US009753388B2

(12) United States Patent
Tamagaki et al.

(10) Patent No.: US 9,753,388 B2
(45) Date of Patent: Sep. 5, 2017

(54) ELECTROSTATIC LATENT IMAGE DEVELOPING TONER

(71) Applicant: KYOCERA Document Solutions Inc., Osaka (JP)

(72) Inventors: Masashi Tamagaki, Osaka (JP); Tomoyuki Ogawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/265,482

(22) Filed: Sep. 14, 2016

(65) Prior Publication Data

US 2017/0075244 A1 Mar. 16, 2017

(30) Foreign Application Priority Data

Sep. 15, 2015 (JP) ..... 2015-181818

(51) Int. Cl.
*G03G 9/093* (2006.01)
*G03G 9/08* (2006.01)

(52) U.S. Cl.
CPC ..... *G03G 9/09321* (2013.01); *G03G 9/0819* (2013.01); *G03G 9/0825* (2013.01)

(58) Field of Classification Search
CPC ..... G03G 9/09321; G03G 9/09328
See application file for complete search history.

(56) References Cited

U.S. PATENT DOCUMENTS 9,625,846 B2 * 4/2017 Liu ..... G03G 9/09392

FOREIGN PATENT DOCUMENTS

JP 2013-011644 A 1/2013
WO WO2014/101358 * 7/2014 ..... G03G 9/093

* cited by examiner

*Primary Examiner* — Hoa V Le
(74) *Attorney, Agent, or Firm* — Studebaker & Brackett PC

(57) ABSTRACT

A shell layer of a toner particle includes first resin particles containing no charge control agent and second resin particles containing a charge control agent. A number average particle diameter of the first resin particles is at least 30 nm and no greater than 60 nm, and a number average particle diameter of the second resin particles is at least 30 nm and no greater than 60 nm. A shell coverage is at least 60% and no greater than 80%. A shell chargeable ratio is at least 0.10 and no greater than 0.20. A roughness of surface regions of toner particles in which no external additive is present is at least 10 nm and no greater than 15 nm.

9 Claims, 2 Drawing Sheets

ELECTROSTATIC LATENT IMAGE DEVELOPING TONER

INCORPORATION BY REFERENCE

The present application claims priority under 35 U.S.C. §119 to Japanese Patent Application No. 2015-181818, filed on Sep. 15, 2015. The contents of this application are incorporated herein by reference in their entirety.

BACKGROUND

The present disclosure relates to an electrophotographic toner, and in particular relates to a capsule toner.

Toner particles included in a capsule toner each include a core and a shell layer (capsule layer) disposed over a surface of the core. The shell layer covers the core of each toner particle of the capsule toner. In the above configuration, the capsule toner tends to be excellent in high-temperature preservability. For example, a toner has been known that has a coverage of spheroidal particles for shell layer use covering the cores of at least 10% and no greater than 50%.

SUMMARY

An electrostatic latent image developing toner according to the present disclosure includes a plurality of toner particles each including a core and a shell layer disposed over a surface of the core. The shell layer includes first resin particles containing no charge control agent and second resin particles containing a charge control agent. A number average particle diameter of the first resin particles is at least 30 nm and no greater than 60 nm, and a number average particle diameter of the second resin particles is at least 30 nm and no greater than 60 nm. A rate of an area of a surface region of the core covered with at least one of the first resin particles and the second resin particles relative to an area of an entire surface region of the core is at least 60% and no greater than 80%. A ratio of an area of a surface region of the core covered with the second resin particles relative to the area of the surface region of the core covered with at least one of the first resin particles and the second resin particles is at least 0.10 and no greater than 0.20. A roughness of surface regions of the toner particles in which no external additive is present is at least 10 nm and no greater than 15 nm.

DETAILED DESCRIPTION

Figure 1:
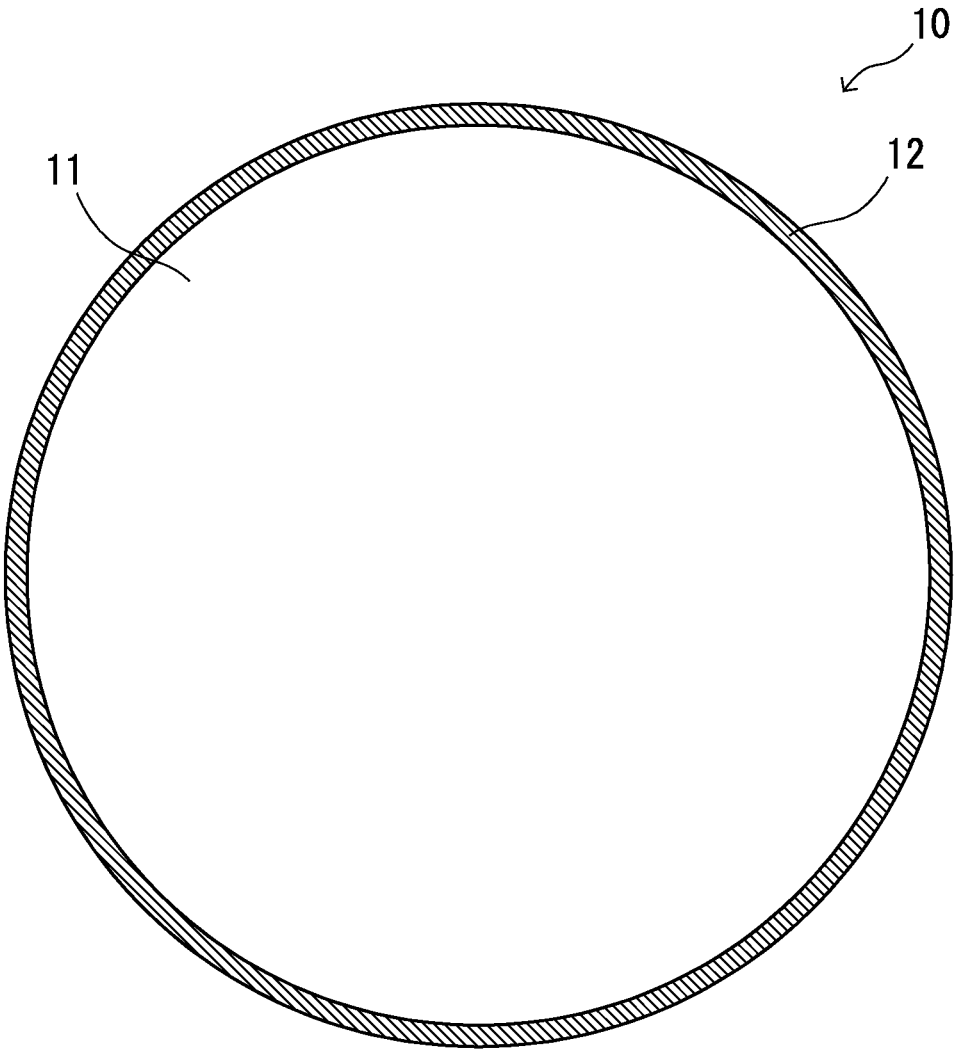
FIG. 1 is a cross sectional view illustrating an example of a toner particle (specifically, a toner mother particle) included in an electrostatic latent image developing toner according to an embodiment of the present disclosure.

The following explains an embodiment of the present disclosure in detail. Unless otherwise stated, evaluation results (for example, values indicating shape and physical properties) for a powder (specific examples include toner cores, toner mother particles, external additive, and toner) are number averages of values measured for a suitable number of particles. Unless otherwise stated, the number average particle diameter of a powder is a number average value of an equivalent circular diameter of a primary particle (diameter of a circle having the same area of a projected area of the particle) measured using a microscope. Unless otherwise stated, a measured value of the volume median diameter ($D_{50}$) of a powder is a value measured using Coulter Counter Multisizer 3 produced by Beckman Coulter, Inc. Respective measured values of an acid value and a hydroxyl value are values measured in accordance with Japan Industrial Standard (JIS) K0070-1992, unless otherwise stated. Respective measured values of a number average molecular weight (Mn) and a mass average molecular weight (Mw) are values measured by gel permeation chromatography, unless otherwise stated. In the present description, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. In the present description, the term "(meth)acryl" is used as a generic term for both acryl and methacryl. Also, the term "(meth)acryloyl group" is used as a generic term for both an acryloyl group ($CH_2{=}CH{-}CO{-}$) and (meth)acryloyl group ($CH_2{=}C(CH_3){-}CO{-}$).

A toner according to the present embodiment can be favorably used for example as a positively chargeable toner for development of an electrostatic latent image. The toner according to the present embodiment is a powder including a plurality of toner particles (particles each having structure described later). The toner may be used as a one-component developer. Alternatively, a two-component developer may be prepared by mixing the toner with a carrier using a mixer (specific examples include a ball mill). A ferrite carrier is preferably used as a carrier in order to form a high-quality image. It is preferable to use magnetic carrier particles each including a carrier core and a resin layer that covers the carrier core in order to form high-quality images for a long period of time. Carrier cores may be formed from a magnetic material (for example, a ferromagnetic material such as ferrite) or a resin in which magnetic particles are dispersed in order to impart magnetism to the carrier particles. Alternatively, magnetic particles may be dispersed in a resin layer that covers the carrier core. The amount of the toner in a two-component developer is preferably at least 5 parts by mass and no greater than 15 parts by mass relative to 100 parts by mass of the carrier in order to form a high-quality image. Note that a positively chargeable toner included in the two-component developer is positively charged by friction with the carrier.

The toner particles included in the toner according to the present embodiment each include a core (also referred to below as a toner core) and a shell layer (capsule layer) disposed over a surface of the toner core. The toner core contains a binder resin. The toner core may optionally contain an internal additive (for example, a colorant, a releasing agent, a charge control agent, and a magnetic powder). An external additive may be attached to a surface of the shell layer (or a surface region of the toner core that is not covered with the shell layer). Note that the external additive may be omitted in a situation in which such additives are not necessary. Hereinafter, toner particles that are yet to be subjected to addition of an external additive are referred to as toner mother particles. A material for forming the shell layer is referred to as a shell material. The toner according to the present embodiment can be used for example for image formation in an electrophotographic apparatus (image forming apparatus). Following describes an example of an image forming method using an electrophotographic apparatus.

First, an image forming section (a charger and an exposure device) of the electrophotographic apparatus forms an electrostatic latent image on a photosensitive member (for example, a surface layer portion of a photosensitive drum) based on image data. Next, the formed electrostatic latent image is developed using a developer containing a toner. In a development process, toner (for example, toner charged by friction between the toner and the carrier or a blade) on a development sleeve (for example, a surface layer portion of a development roller in the developing device) disposed in the vicinity of the photosensitive member is attached to the electrostatic latent image to form a toner image on the photosensitive member. In a subsequent transfer process, the toner image on the photosensitive member is transferred to an intermediate transfer member (for example, a transfer belt), and the toner image on the intermediate transfer member is further transferred to a recording medium (for example, paper). Thereafter, a fixing device (fixing method: nip fixing using a heating roller and a pressure roller) applies heat and pressure to the toner to fix the toner to the recording medium. As a result, an image is formed on the recording medium. A full-color image can be obtained by superimposing toner images formed using different colors, such as black, yellow, magenta, and cyan. A belt fixing method may be adopted as a fixing method.

The toner according to the present embodiment is an electrostatic latent image developing toner having the following structure (also referred to below as basic structure).

(Basic Structure of Toner)

The electrostatic latent image developing toner includes a plurality of toner particles each including a toner core and a shell layer. The shell layer includes first resin particles containing no charge control agent and second resin particles containing a charge control agent. The first resin particles have a number average particle diameter of at least 30 nm and no greater than 60 nm, and the second resin particles have a number average particle diameter of at least 30 nm and no greater than 60 nm. A rate of an area of a surface region of the toner core covered with at least one of the first resin particles and the second resin particles relative to an area of an entire surface region of the toner core (hereinafter referred to as a shell coverage) is at least 60% and no greater than 80%. A ratio of an area of a surface region of the toner core covered with the second resin particles relative to the area of the surface region of the toner core covered with at least one of the first resin particles and the second resin particles (hereinafter referred to as a shell chargeable ratio) is at least 0.10 and no greater than 0.20. A surface region of the toner particle in which no external additive is present has a roughness (hereinafter referred to as a shell roughness) of at least 10 nm and no greater than 15 nm. The first resin particles and the second resin particles are also referred to below collectively as "shell particles".

The number average particle diameter of the shell particles herein is a number average value of equivalent circular diameters of respective primary particles (diameters of circles having the same areas as projected areas of respective particles) measured using a microscope.

The state of a surface region of the toner core can be divided into: a first state of being covered only with a first resin particle; a second state of being covered only with a second resin particle; a third state of being covered with both a first resin particle and a second resin particle (specifically, a first region particle and a second resin particle that are stacked on one on the other); and a fourth state of being covered with neither the first resin particles nor the second resin particles. A surface region of the toner core in any of the first to third states corresponds to a surface region of the toner core covered with at least one of the first resin particles and the second resin particles in the basic structure (hereinafter referred to as a shell covering surface region). Further, a surface region of the toner core in the second or third state corresponds to a surface region of the toner core covered with the second resin particles in the basic structure (hereinafter referred to as a chargeable surface region). An area of the shell covering surface region corresponds to a sum of an area of the surface region in the first state, an area of the surface region in the second state, and an area of the surface region in the third state. An area of the chargeable surface region corresponds to a sum of the area of the surface region in the second state and the area of the surface region in the third state. In the above basic structure, the shell coverage is expressed by an equation "shell coverage (unit: %)=100×(area of shell covering surface region)/(area of entire surface region of toner core)". The shell chargeable ratio is expressed by an equation "shell chargeable ratio=(area of chargeable surface region)/(area of shell covering surface region)".

The shell roughness is an arithmetic mean roughness (specifically, an arithmetic mean roughness Ra defined in accordance with Japan Industrial Standard (JIS) B0601-2013). The shell roughness may be measured before or after external addition. In a situation in which a shell roughness of a toner particle subjected to external addition is measured, a shell roughness of a portion of a toner particle other than a portion thereof in which a external additive is present may be measured. Alternatively, a shell roughness of a toner particle may be measured after the external additive attached to a toner mother particle is removed. For external additive removal, the external additive may be removed from the toner particles by being dissolved in a solution (for example, an alkali solution) or taken away from the toner particles using a ultrasonic cleaner.

Respective measuring methods of the shell coverage, the shell chargeable ratio, and the shell roughness are the same as those adopted in Examples described later or alternative methods thereof.

The toner having the basic structure can enable continuous high-quality image formation while inhibiting continual fogging from occurring for a long period of time (see Tables 1 and 2 indicated later) even in a situation in which the toner is used in continuous printing (for example, 5,000-sheet continuous printing). Containment of the second resin particles in the shell layer is considered to improve chargeability of the toner. In a configuration in which the shell particles have a number average particle diameter of at least 30 nm and no greater than 60 nm, chargeability and durability of the toner necessary for inhibiting fogging from occurring in a long period of time is considered to be ensured easily. Specifically, shell particles having an excessively large number average particle diameter tend to readily separate from the toner particles. By contrast, shell particles having a too small number average particle diameter tend to be readily embedded in the toner cores. Furthermore, shell particles having a number average particle diameter of at least 30 nm are considered to function as spacers among the toner particles to inhibit agglomeration of the toner particles.

Furthermore, in the above basic structure: the shell coverage is at least 60% and no greater than 80%; the shell chargeable ratio is at least 0.10 and no greater than 0.20; and the shell roughness is at least 10 nm and no greater than 15 nm. In a configuration in which the shell chargeable ratio is at least 0.10 and no greater than 0.20 and the shell roughness is at least 10 nm and no greater than 15 nm, the toner tends to have appropriate chargeability. In a configuration in which the shell coverage is at least 60% and no greater than 80%, the toner is considered to tend to have excellent chargeability, durability and low-temperature fixability. Chargeability and durability of the toner tend to improve as the shell coverage is increased. By contrast, the toner tends to be readily fixed at low temperature as the shell coverage is decreased.

Figure 2:
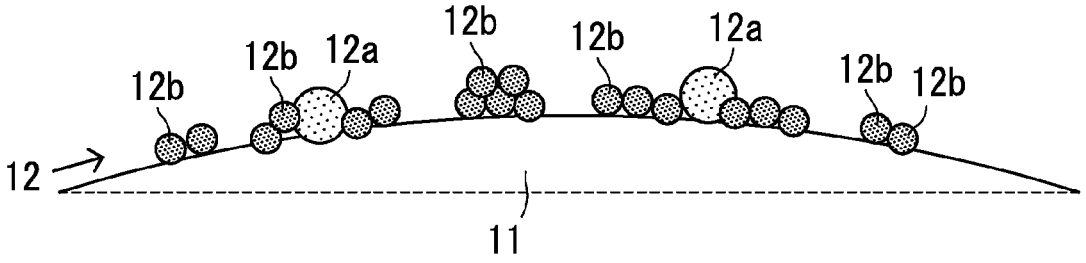
FIG. 2 is an enlarged view of a part of a surface of the toner mother particle illustrated in FIG. 1.

Following describes an example of structure of the toner according to the present embodiment with reference to FIGS. 1 and 2. FIG. 1 illustrates an example of structure of a toner particle (specifically, a toner mother particle) included in the toner according to the present embodiment. FIG. 2 is an enlarged view of a part of the toner mother particle illustrated in FIG. 1.

A toner mother particle 10 illustrated in FIG. 1 includes a toner core 11 and a shell layer 12 disposed over a surface of the toner core 11. The shell layer 12 is formed substantially from a resin. The shell layer 12 covers a surface region of the toner core 11.

As illustrated in FIG. 2, the shell layer 12 of the toner mother particle 10 includes a plurality of first resin particles 12*b* and a plurality of second resin particles 12*a*. Respective parts (bottom parts) of the first resin particles 12*b* and the second resin particles 12*a* may be embedded in the toner core 11, as illustrated in FIG. 2. In the example illustrated in FIG. 2 the second resin particles 12*a* have a number average particle diameter larger than the first resin particles 12*b*. However, the present disclosure is not limited to this. The first resin particles 12*b* may have a number average particle diameter larger than the second resin particles 12*a*.

The toner according to the present embodiment includes a plurality of toner particles defined to have the above basic structure (hereinafter referred to as toner particles of the present embodiment). The toner including the toner particles of the present embodiment is considered to enable continuous formation of high-quality images while inhibiting continual fogging from occurring for a long period of time (see Tables 1 and 2 indicated later). Note that the toner preferably includes the toner particles of the present embodiment at a rate of at least 80% by number, more preferably at least 90% by number, and further preferably 100% by number in order to improve chargeability and durability of the toner. Toner particles each including no shell layer may be included in the toner.

The toner preferably has a volume median diameter ($D_{50}$) of at least 1 μm and less than 10 μm in order to improve both high-temperature preservability and low-temperature fixability of the toner.

Next, the toner core (a binder resin and an internal additive), the shell layer, and the external additive will be described in stated order. A component (for example, an internal additive or an external additive) that is not necessary may be omitted according to the purpose of the toner.

<Preferable Thermoplastic Resin>

Examples of thermoplastic resins that can be preferably used for forming the toner particles (especially, the toner cores and the shell layers) include styrene-based resins, acrylic acid-based resins (specific examples include an acrylic acid ester polymer and a methacrylic acid ester polymer), olefin-based resins (specific examples include a polyethylene resin and a polypropylene resin), vinyl chloride resins, polyvinyl alcohol, vinyl ether resins, N-vinyl resins, polyester resins, polyamide resins, and urethane resins. A copolymer of any of the resins listed above, that is, a copolymer of any of the resins listed above into which an optional repeating unit is introduced (specific examples include a styrene-acrylic acid-based resin or a styrene-butadiene-based resin) is also preferable as a thermoplastic resin forming the toner particles.

A styrene-acrylic acid-based resin is a copolymer of one or more styrene-based monomers and one or more acrylic acid-based monomers. In a situation in which a styrene-acrylic acid-based resin is synthesized, any of styrene-based monomers and any of acrylic acid-based monomers listed below for example can be used favorably. Use of an acrylic acid-based monomer having a carboxyl group can result in introduction of the carboxyl group into a styrene-acrylic acid-based resin. Use of a monomer having a hydroxyl group (specific examples include p-hydroxystyrene, m-hydroxystyrene, and (meth)acrylic acid hydroxyalkyl ester) can result in introduction of the hydroxyl group into a styrene-acrylic acid-based resin. The acid value of a resultant styrene-acrylic acid-based resin can be adjusted through appropriate adjustment of the amount of the acrylic acid monomer. The hydroxyl value of the resultant styrene-acrylic acid-based resin can be adjusted through appropriate adjustment of the amount of a monomer having the hydroxyl group.

Examples of preferable styrene-based monomers include styrene, α-methylstyrene, p-hydroxy styrene, m-hydroxy styrene, vinyltoluene, α-chlorostyrene, o-chlorostyrene, m-chlorostyrene, p-chlorostyrene, and p-ethylstyrene.

Examples of preferable acrylic acid-based monomers include (meth)acrylic acids, (meth)acrylic acid alkyl esters, and (meth)acrylic acid hydroxyalkyl esters. Examples of preferable (meth)acrylic acid alkyl esters include (meth) methyl acrylate, (meth)ethyl acrylate, (meth)n-propyl acrylate, (meth)iso-propyl acrylate, (meth)n-butyl acrylate, (meth)iso-butyl acrylate, and (meth)2-ethylhexyl acrylate. Examples of preferable (meth)acrylic acid hydroxyalkyl esters include (meth)acrylic acid2-hydroxyethil, (meth) acrylic acid3-hydroxypropyl, (meth)acrylic acid2-hydroxypropyl, and (meth)acrylic acid4-hydroxybutyl.

A polyester resin can be yielded by condensation polymerization of one or more polyhydric alcohols and one or more polyvalent carboxylic acids. Examples of alcohols that can be used for synthesis of a polyester resin include dihydric alcohols (specific examples include diols and bisphenols) and tri- or higher-hydric alcohols listed below. Examples of carboxylic acids that can be preferably used for synthesis of a polyester resin include divalent carboxylic acids and tri- or higher-valent carboxylic acids listed below. The acid value and the hydroxyl value of a polyester resin can be adjusted through adjustment of the respective amounts of an alcohol and an carboxylic acid used during synthesis of the polyester resin. Increasing the molecular weight of a polyester resin tends to decrease the acid value and the hydroxyl value of the polyester resin.

Examples of preferable diols include ethylene glycol, diethylene glycol, triethylene glycol, 1,2-propanediol, 1,3-propanediol, 1,4-butanediol, neopentyl glycol, 2-butene-1, 4-diol, 1,5-pentanediol, 1,6-hexanediol, 1,4-cyclohexanedimethanol, dipropylene glycol, polyethylene glycol, polypropylene glycol, and polytetramethylene glycol.

Examples of preferable bisphenols include bisphenol A, hydrogenated bisphenol A, bisphenol A ethylene oxide adducts, and bisphenol A propylene oxide adducts.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable divalent carboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (specific examples include an n-butylsuccinic acid, an isobutylsuccinic acid, an n-octylsuccinic acid, an n-dodecylsuccinic acid, and an isododecylsuccinic acid), and alkenylsuccinic acids (specific examples include an n-butenylsuccinic acid, an isobutenylsuccinic acid, an n-octenylsuccinic acid, an n-dodecenylsuccinic acid, and an isododecenylsuccinic acid).

Examples of preferable tri- or higher-valent carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

[Toner Core]

(Binder Resin)

The binder resin is typically a main component (for example, at least 85% by mass) of the toner cores. Properties of the binder resin are therefore expected to have great influence on an overall property of the toner cores. The toner cores have a strong tendency to be anionic when the binder resin has a group such as an ester group, a hydroxyl group, an ether group, an acid group, or a methyl group. By contrast, the toner cores have a strong tendency to be cationic when the binder resin has a group such as an amino group or an amide group. In order that the binder resin is strongly anionic, the hydroxyl value and the acid value of the binder resin each are preferably no less than 10 mg KOH/g.

The binder resin preferably has one or more groups selected from the group consisting of an ester group, a hydroxyl group, an ether group, an acid group, and a methyl group with either or both of a hydroxyl group and a carboxyl group being more preferable. The binder resin having such a functional group can readily react with the shell material to form chemical bonds. Such chemical binding causes strong binding between the toner cores and the shell layers. Furthermore, the binder resin preferably has an activated hydrogen-containing functional group in molecules thereof.

The binder resin preferably has a glass transition point (Tg) of at least 20° C. and no greater than 55° C. in order to improve fixability of the toner in high speed fixing. The binder resin preferably has a softening point (Tm) of no greater than 100° C. in order to improve fixability of the toner in high speed fixing. Note that methods for measuring Tg and Tm are the same as those described in Examples described later or alternative methods thereof. Changing the type or amount (blend ratio) of the components (monomers) of the resin can result in adjustment of either or both of Tg and Tm of the resin. A combination of plural types of resins can also result in adjustment of either or both of Tg and Tm of the binder resin.

The binder resin of the toner cores is preferably a thermoplastic resin (specific examples include "examples of preferable thermoplastic resins" listed above). A styrene-acrylic acid-based resin or a polyester resin is preferably used as the binder resin in order to improve dispersibility of a colorant in the toner core, chargeability of the toner, and fixability of the toner to a recording medium.

In a configuration in which a styrene-acrylic acid-based resin is used as the binder resin of the toner cores, the styrene-acrylic acid-based resin preferably has a number average molecular weight (Mn) of at least 2,000 and no greater than 3,000 in order to improve strength of the toner cores and fixability of the toner. The styrene-acrylic acid-based resin preferably has a molecular weight distribution (ratio Mw/Mn of mass average molecular weight (Mw) relative to number average molecular weight (Mn)) of at least 10 and no greater than 20.

In a configuration in which a polyester resin is used as the binder resin of the toner cores, the polyester resin preferably has a number average molecular weight (Mn) of at least 1,000 and no greater than 2,000 in order to improve strength of the toner cores and fixability of the toner. The polyester resin preferably has a molecular weight distribution (ratio Mw/Mn of mass average molecular weight (Mw) relative to number average molecular weight (Mn)) of at least 9 and no greater than 21.

(Colorant)

The toner cores may each contain a colorant. The colorant can be a known pigment or dye that matches the color of the toner. The amount of the colorant is preferably at least 1 part by mass and no greater than 20 parts by mass relative to 100 parts by mass of the binder resin in order to form a high-quality image using the toner.

The toner cores may contain a black colorant. Carbon black can for example be used as a black colorant. Alternatively, a colorant that is adjusted to a black color using a yellow colorant, a magenta colorant, and a cyan colorant can for example be used as a black colorant.

The toner cores may contain a non-black colorant such as a yellow colorant, a magenta colorant, or a cyan colorant.

One or more compounds selected from the group consisting of condensed azo compounds, isoindolinone compounds, anthraquinone compounds, azo metal complexes, methine compounds, and arylamide compounds can preferably be used for example as a yellow colorant. Specific examples of yellow colorants that can be preferably used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C.I. Vat Yellow.

One or more compounds selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can preferably be used for example as a magenta colorant. Specific examples of magenta colorants that can be preferably used include C.I. Pigment Red (for example, 2, 3, 5, 6, 7, 19, 23, 48:2, 48:3, 48:4, 57:1, 81:1, 122, 144, 146, 150, 166, 169, 177, 184, 185, 202, 206, 220, 221, and 254).

One or more compounds selected from the group consisting of copper phthalocyanine compounds, anthraquinone compounds, and basic dye lake compounds can preferably be used for example as a cyan colorant. Examples of cyan colorants that can be preferably used include C.I. Pigment Blue (1, 7, 15, 15:1, 15:2, 15:3, 15:4, 60, 62, and 66), Phthalocyanine Blue, C.I. Vat Blue, and C.I. Acid Blue.

(Releasing Agent)

The toner cores may each contain a releasing agent. The releasing agent is for example used in order to improve fixability of the toner or resistance of the toner to being offset. The toner cores are preferably produced using an anionic wax in order to increase anionic strength of the toner cores. The amount of the releasing agent is preferably at least 1 part by mass and no greater than 30 parts by mass relative to 100 parts by mass of the binder resin in order to improve fixability or offset resistance of the toner.

Examples of releasing agents that can be used include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a main component such as montanic acid ester wax and castor wax; and waxes in which a part or all of a fatty acid ester has been deoxidized such as deoxidized carnauba wax. One of the releasing agents listed above may be used, or a combination of two or more of the releasing agents listed above may be used.

A compatibilizer may be added to the toner cores in order to improve compatibility between the binder resin and the releasing agent.

(Charge Control Agent)

The toner cores may each contain a charge control agent. The charge control agent is for example used in order to improve charge stability or a charge rise characteristic of the toner. The charge rise characteristic of the toner is an indicator as to whether the toner can be charged to a specific charge level in a short period of time.

Containment of a negatively chargeable charge control agent (specific examples include an organic metal complex and a chelate compound) in the toner cores can increase anionic strength of the toner cores. By contrast, containment of a positively chargeable charge control agent (specific examples include pyridine, nigrosine, and quaternary ammonium salt) in the toner cores can increase cationic strength of the toner core. However, the toner cores need not to contain a charge control agent in a configuration in which sufficient chargeability of the toner can be ensured.

(Magnetic Powder)

The toner cores may each contain a magnetic powder. Examples of materials of the magnetic powder that can be preferably used include ferromagnetic metals (specific examples include iron, cobalt, nickel, and an alloy containing one or more of the listed metals), ferromagnetic metal oxides (specific examples include ferrite, magnetite, and chromium dioxide), and materials subjected to ferromagnetization (specific examples include carbon materials to which ferromagnetism is imparted through thermal treatment). One type of the magnetic powders listed above may be used, or a combination of two or more types of the magnetic powders listed above may be used.

The magnetic powder is preferably subjected to surface treatment in order to inhibit elution of metal ions (e.g., iron ions) from the magnetic powder. In a situation in which the shell layers are formed over the surfaces of the toner cores under acidic conditions, elution of metal ions to the surfaces of the toner cores causes the toner cores to adhere to one another more readily. It is considered that inhibition of elution of metal ions from the magnetic powder can inhibit toner cores from adhering to one another.

[Shell Layer]

The toner according to the present embodiment has the aforementioned basic structure. The shell layer includes the first resin particles and the second resin particles. The first resin particles contain no contain charge control agent. The second resin particles contain the charge control agent.

Preferably, the first resin particles and the second resin particles are each formed substantially from a thermoplastic resin (specific examples include the "examples of preferable thermoplastic resins" listed above) in order to improve both high-temperature preservability and low-temperature fixability of the toner.

The resin that forms the first resin particles and the resin that forms the second resin particles each preferably have a repeating unit derived from a vinyl compound in order to sufficiently ensure film properties of the shell layers. Preferably, the first resin particles and the second resin particles each are formed substantially from an acrylic acid-based resin or a styrene-acrylic acid-based resin. When a resin is yielded by polymerization of a vinyl compound having a functional group according to performance to be imparted to the toner, desired performance can be imparted to the toner readily and accurately. Note that a repeating unit derived from a vinyl compound in a resin is considered to be addition polymerized through carbon double bonding "C═C". The vinyl compound is a compound having a vinyl group ($CH_2$═CH—) or a vinyl group in which hydrogen is substituted. Examples of vinyl compounds that can be used include ethylene, propylene, butadiene, vinyl chloride, acrylic acid, acrylic acid ester, methacrylic acid, methacrylic acid ester, acrylonitrile, styrene, and (meth)acryloyl group-containing quaternary ammonium compounds listed below.

In order that the second resin particles each contain a charge control agent, a repeating unit derived from a charge control agent may be incorporated in a resin that forms the second resin particles or chargeable particles may be dispersed in a resin that forms the second resin particles. However, in order to produce a toner excellent in chargeability, high-temperature preservability, and low-temperature fixability, the second resin particles are preferably formed substantially from a resin having a repeating unit derived from a charge control agent and more preferably a resin having a repeating unit derived from a (meth)acryloyl group-containing quaternary ammonium compound. Specifically, the second resin particles are each preferably formed substantially from a resin having a repeating unit represented by the following formula (1) or a salt thereof. Examples of (meth)acryloyl group-containing quaternary ammonium compounds that can be preferably used include methacryloyloxy alkyl trimethyl ammonium salts (specific examples include 2-(methacryloyloxy)ethyl trimethylammonium chloride).

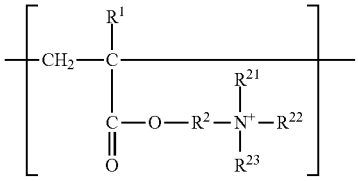

(1)

In formula (1), $R^1$ represents a hydrogen atom or a methyl group and $R^{21}$, $R^{22}$, and $R^{23}$ represent, independently of one another, a hydrogen atom, an optionally substituted alkyl group, or an optionally substituted alkoxy group. Further, $R^2$ represents an optionally substituted alkylene group. Preferably, $R^{21}$, $R^{22}$, and $R^{23}$ represent, independently of one another, an alkyl group having a carbon number of at least 1 and no greater than 8, and more preferably a methyl group, an ethyl group, an n-propyl group, an iso-propyl group, an n-butyl group, or an iso-butyl group. Preferably, $R^2$ represents an alkylene group having a carbon number of at least 1 and no greater than 6, and more preferably a methylene group or an ethylene group. In the repeating unit derived from 2-(methacryloyloxy)ethyl trimethylammonium chloride: $R^1$ represents a methyl group; $R^2$ represents an ethylene group; and $R^{21}$ to $R^{23}$ each represents a methyl group. Further, quaternary ammonium cation ($N^+$) is ionically bonded to chlorine (Cl) to form a salt.

The respective resins forming the first resin particles and the second resin particles are preferably hydrophobic in order to improve charge stability of the toner. Specifically, a rate of a repeating unit having a hydrophilic functional group is preferably no greater than 10% by mass relative to all repeating units included in each of the resin forming the first resin particles and having a repeating unit derived from a vinyl compound and the resin forming the second resin particles and having a repeating unit derived from a vinyl compound. In order that a resin is hydrophobic, the rate of the repeating unit having a hydrophilic functional group to all the repeating units included in each resin is preferably no greater than 10% by mass. Examples of possible hydrophilic functional groups include acid groups (specific examples include a carboxyl group and a sulfo group), a hydroxyl group, and a salt of any of the above groups (specific examples include —COONa, —$SO_3$Na, and —ONa). Hydrophobicity (or hydrophilicity) can be for example represented by a contact angle of a water drop (water wettability). The larger the contact angle of a water drop, the stronger the hydrophobicity.

[External Additive]

Inorganic particles may be attached to surfaces of the toner mother particles as an external additive. When the toner mother particles (powder) and the external additive (powder of inorganic particles) are stirred together, parts (bottom parts) of the inorganic particles are embedded in surface layer portions of the toner mother particles such that the inorganic particles are attached to the surfaces of the toner mother particles by a physical power (physical bond). The external additive is used for example to improve fluidity or handling property of the toner. The amount of the external additive is preferably at least 0.5 parts by mass and no greater than 10 parts by mass relative to 100 parts by mass of the toner mother particles in order to improve fluidity or handling property of the toner. In order to improve fluidity or handling property of the toner, the external additive preferably has a particle diameter of at least 0.01 μm and no greater than 1.0 μm.

Examples of external additive particles (inorganic particles) that can be preferably used include silica particles and particles of metal oxides (specific examples include alumina, titanium oxide, magnesium oxide, zinc oxide, strontium titanate, and barium titanate). One type of external additive particles may be used, or a combination of two or more types of external additive particles may be used.

[Toner Production Method]

Following describes an example of a method for producing the toner according to the present embodiment that has the aforementioned basic structure. First of all, toner cores are prepared. Subsequently, the toner cores and a shell material are added to a liquid. It is preferable to dissolve or disperse the shell material in the liquid by for example stirring the liquid including the shell material in order to form a homogenous shell layer. Then, the shell material is caused to react in the liquid to form shell layers (hardened resin layers) on the surfaces of the toner cores. In order to inhibit dissolution or elution of toner core components (particularly, a binder resin and a releasing agent) during formation of the shell layers, the formation of the shell layers is preferably carried out in an aqueous medium. The aqueous medium is a medium of which main component is water (specific examples include pure water and a mixed liquid of water and a polar medium). The aqueous medium may function as a solvent. A solute may be dissolved in the aqueous medium. The aqueous medium may function as a dispersion medium. A dispersoid may be dispersed in the aqueous medium. Examples of polar mediums in the aqueous medium that can be used include alcohols (specific examples include methanol and ethanol).

Following describes a method for producing the toner according to the present embodiment by referring to a more specific example.

(Preparation of Toner Cores)

In order to easily obtain preferable toner cores, the toner cores are preferably produced according to an aggregation method or a pulverization method and more preferably according to the pulverization method.

An example of the pulverization method will be described below. First, a binder resin and an internal additive (for example, at least one of a colorant, a releasing agent, a charge control agent, and a magnetic powder) are mixed together. Subsequently, the resultant mixture is melt-knead. The resultant melt-knead substance is pulverized and classified. Through the above, toner cores having a desired particle diameter can be obtained.

An example of the aggregation method will be described below. First, binder resin particles, releasing agent particles, and colorant particles are aggregated until the particles have respective desired particle diameters in an aqueous medium including the respective particles. As a result, aggregated particles of the binder resin, the releasing agent, and the colorant are formed. Subsequently, the resultant aggregated particles are heated for coalescence of the components contained in the aggregated particles. As a result, a dispersion of the toner cores is obtained. Thereafter, unnecessary substances (a surfactant and the like) are removed from the dispersion of the toner cores to obtain toner cores.

(Formation of Shell Layer)

An aqueous medium (for example, ion exchanged water) is prepared as the liquid to which the toner cores and the shell material are added. Subsequently, the pH of the aqueous medium is adjusted to a specific pH (for example, 4) using for example hydrochloric acid. Then, the toner cores, a suspension of the first resin particles, and a suspension of the second resin particles are added to the aqueous medium of which pH has been adjusted (for example, an acid aqueous medium).

The toner cores and the shell material may be added to the aqueous medium at room temperature or the aqueous medium of which temperature is adjusted (kept) at a specific temperature. An appropriate amount of the shell material to be added can be calculated based on the specific surface area of the toner cores. Further, a polymerization accelerator may be added to the aqueous medium in addition to the toner cores and the like.

The first resin particles and the second resin particles are attached to the surfaces of the toner cores in the liquid. Preferably, the toner cores are highly dispersed in the liquid including the first resin particles and the second resin particles in order to uniformly attach the first resin particles and the second resin particles to the surfaces of the toner cores. In order to highly disperse the toner cores in the liquid, the liquid may contain a surfactant or be stirred using a high-power stirrer (for example, "Hivis Disper Mix" produced by PRIMIX Corporation). In a configuration in which the toner cores are anionic, agglomeration of the toner cores can be inhibited by using an anionic surfactant that has the same polarity as that of the toner cores. Examples of surfactants that can be used include sulfate ester salts, sulfonic acid salts, phosphate ester salts, and soap.

Subsequently, the temperature of the liquid including the toner cores and the first and second resin particles is increased to a specific maintenance temperature (for example, a temperature of at least 50° C. and no greater than 85° C.) at a specific speed (for example, a speed of at least 0.1° C./min. and no greater than 3° C./min.) while the liquid is stirred. Furthermore, the temperature of the liquid is kept at the maintenance temperature for a specific period of time (for example, at least 30 minutes and no greater than four hours) while the liquid is stirred. During the liquid being kept at high temperature (or during temperature increase), the first resin particles and the second resin particles are attached to the surfaces of the toner cores and react with the toner cores. When the first resin particles and the second resin particles bond to the toner cores, shell layers are formed. Formation of the shell layers on the surfaces of the toner cores in the liquid results in production of a dispersion of toner mother particles.

After formation of the shell layers as above, the dispersion of the toner mother particles is cooled to for example normal temperature (approximately 25° C.). The dispersion of the toner mother particles are then filtered using for example a Buchner funnel. Filtration of the dispersion of the toner mother particles separates the toner mother particles from the liquid (solid-liquid separation), thereby collecting a wet cake of the toner mother particles. Next, the resultant wet cake of the toner mother particles is washed. The toner mother particles that have been washed are then dried. A vacuum mixer dryer equipped with a stirring impeller can be used for drying the toner mother particles. For example, the toner mother particles are dried while being stirred in a vessel of which pressure is reduced to for example no greater than 10 kPa and of which temperature is kept high using a jacket for temperature adjustment (for example, a warm water jacket). Changing drying conditions (for example, drying temperature and stirring speed) can result in adjustment of the aspects of the shell layers (for example, shell coverage and shell roughness). The shell roughness tends to reduce as the stirring speed is increased. Also, the shell coverage tends to increase as the drying temperature is increased.

Thereafter, as necessary, the toner mother particles may be mixed with an external additive using a mixer (for example, FM mixer produced by Nippon Coke & Engineering Co., Ltd.) to attach the external additive to the surfaces of the toner mother particles. Through the above, a toner including multiple toner particles is produced.

Note that processes and order of the method for producing the toner described above may be changed freely in accordance with desired structure, characteristics, and the like of the toner. For example, in a situation in which a material (for example, the shell material) is caused to react in the liquid, the material may be caused to react in the liquid for a specific time period after addition of the material to the liquid. Alternatively, the material may be caused to react in the liquid while being added to the liquid over a long period of time. Further, the shell material may be added to the liquid at once or plural times. The toner may be sifted after external addition. Also, non-essential processes may alternatively be omitted. For example, in a method in which a commercially available product can be used directly as a material, use of the commercially available product can omit the process of preparing the material. In a method in which reaction for forming the shell layers progresses favorably even without pH adjustment of the liquid, the process of pH adjustment may be omitted. In a method in which no external additive is necessary, the external addition process may be omitted. In a method in which an external additive is not attached to the surfaces of the toner mother particles (i.e., a method in which the external addition process is omitted), the toner mother particles are equivalent to the toner particles. A prepolymer may be used instead of a monomer as a material for resins synthesis depending on necessity. In order to yield a specific compound, a salt, ester, hydrate, or anhydride of the compound may be used as a raw material. Preferably, a large number of the toner particles are formed at the same time in order to produce the toner efficiently. The toner particles produced at the same time are considered to have substantially the same configuration.

EXAMPLES

Following describes examples of the present disclosure. Table 1 indicates toners TA-1 to TA-3, TB-1 to TB-4, TC-1, TC-2, TD, TE-1, TE-2, TF-1, and TF-2 (each are an electrostatic latent image developing toner) according to examples and comparative examples. In Table 1, "particle diameter" indicates a number average value of equivalent circular diameters of primary particles measured using a transmission electron microscope (TEM). In "particle diameter (unit: nm)" in Table 1, "non-chargeable" and "chargeable" mean number average particle diameters of the first resin particles and the second resin particles, respectively.

TABLE 1

| | Drying conditions | | Particle diameter [nm] | | Shell | Shell | Shell |
|---|---|---|---|---|---|---|---|
| Toner | Temperature [° C.] | Stirring speed [rpm] | Non-chargeable | Chargeable | roughness [nm] | coverage [%] | chargeable ratio |
| TA-1 | 40 | 30 | 38 | 35 | 13 | 70 | 0.15 |
| TA-2 | | 40 | | | 11 | 75 | 0.17 |
| TA-3 | | 20 | | | 14 | 65 | 0.13 |
| TB-1 | 45 | 30 | 38 | 35 | 12 | 72 | 0.16 |
| TB-2 | | 20 | | | 13 | 70 | 0.14 |
| TB-3 | | 40 | | | 7 | 78 | 0.17 |
| TB-4 | | 10 | | | 14 | 60 | 0.09 |
| TC-1 | 35 | 30 | 38 | 35 | 17 | 65 | 0.15 |
| TC-2 | | 40 | | | 16 | 59 | 0.14 |

TABLE 1-continued

| Toner | Drying conditions Temperature [° C.] | Drying conditions Stirring speed [rpm] | Particle diameter [nm] Non-chargeable | Particle diameter [nm] Chargeable | Shell roughness [nm] | Shell coverage [%] | Shell chargeable ratio |
|---|---|---|---|---|---|---|---|
| TD | 50 | 20 | 38 | 35 | 11 | 81 | 0.21 |
| TE-1 | 45 | 40 | 42 | 35 | 13 | 65 | 0.17 |
| TE-2 | 40 | 30 | | | 18 | 63 | 0.15 |
| TF-1 | 40 | 30 | 38 | 50 | 14 | 70 | 0.13 |
| TF-2 | 40 | 20 | | | 15 | 60 | 0.09 |

Following describes in order methods for producing the respective toners TA-1 to TF-2, evaluation methods, and evaluation results. In evaluations in which errors may occur, an evaluation value was calculated by calculating the arithmetic mean of an appropriate number of measured values in order to ensure that any errors were sufficiently small. Respective measuring methods of Tg (glass transition point) and Tm (softening point) are those described below unless otherwise stated.

<Tg Measuring Method>

A heat absorption curve (vertical axis: heat flow (DSC signals), horizontal axis: temperature) of a sample (for example, a resin) was plotted using a differential scanning calorimeter (for example, "DSC-6200" produced by Seiko Instruments Inc.). Tg (glass transition point) of the sample was then read from the plotted heat absorption curve. Tg (glass transition point) of the sample corresponds to a temperature at a point of change (intersection between an extrapolation line of a base line and an extrapolation line of a fall line) in the specific heat on the heat absorption curve.

<Tm Measuring Method>

A sample (for example, a resin) was placed in a capillary rheometer ("CFT-500D" produced by Shimadzu Corporation), and melt-flow of 1 $cm^3$ of the sample was caused using a die diameter of 1 mm, a plunger load of 20 $kg/cm^2$, and a heating rate of 6° C./min. in order to plot an S-shaped curve (horizontal axis: temperature, vertical axis: stroke). Then, Tm of the sample was read from the S-shaped curve that was plotted. Tm (softening point) of the sample is a temperature on the S-shaped curve corresponding to a stroke value of $(S_1+5_2)/2$ where $S_1$ represents a maximum value of the stroke and $S_2$ represents a base-line stroke value at low-temperature.

Moreover, the shell roughness, the shell coverage, and the shell chargeable ratio of each sample (toners TA-1 to TF-2) were measured according to the following methods. A measuring device for the respective measurements was a scanning probe station ("NanoNaviReal" produced by Hitachi High-Tech Science Corporation) provided with a scanning probe microscope (SPM) ("Multi-function Unit AFM5200S" produced by Hitachi High-Tech Science Corporation). Prior to the measurements, an average toner particle was selected from among the toner particles included in the sample (toner) using a scanning electron microscope (SEM) ("JSM-6700F" produced by JEOL Ltd.) and the selected toner particle was defined as a measurement target. The selected toner particle was set on a measurement table of the measuring device (SPM) directly without being cut. Then, a field of view (measurable range) of the measuring device SPM) was set so that a surface region of the toner particle in which no external additive was present was included in a measurement range.

<Method for Measuring Shell Roughness>

(SPM Measurement Conditions)

Measurement probe: Cantilever ("SI-DF3-R" produced by Hitachi High-Tech Science Corporation, tip radius: 30 nm, probe coating material: rhodium (Rh), spring constant: 1.6 N/m, resonance frequency: 26 kHz).

Measurement mode: Adhesion mode.

Measurement range (per field of view): 1 μm×1 μm.

Resolution (X data/Y data): 256/256.

Amplitude extinction ratio: −0.4.

In the above measurement mode (adhesion mode), a shell roughness (arithmetic mean roughness Ra in a surface region of the toner particle in which no external additive was present) was measured in different fields of view. Each shell roughness (arithmetic mean roughness Ra) of ten toner particles included in the sample (toner) was measured. The number average value of the ten toner particles was defined as an evaluation value (shell roughness) of the sample (toner).

<Method for Measuring Shell Coverage>

(SPM Measurement Conditions)

Measurement probe: Low-spring constant silicon cantilever ("OMCL-AC240TS-C3" produced by Olympus Corporation, spring constant: 2 N/m, resonance frequency: 70 kHz, back reflective coating material: aluminum).

Measurement mode: Dynamic force mode (DFM).

Measurement range (per field of view): 1 μm×1 μm.

Resolution (X data/Y data): 256/256.

Q gain: 1 time.

Scanning frequency: 1 Hz.

A profile image (image showing a surface profile) of a toner particle was captured in a state in which the cantilever having the prove at its tip end is caused to resonate in the above measurement mode (DFM) while the distance between the probe and the toner particle was controlled so that the amplitude of the cantilever that was vibrating was constant. Image analysis was performed on the captured profile image using image analysis software ("WinROOF" produced by Mitani Corporation) and GNU Image Manipulation Program (GIMP, image editing and processing software distributed by GNU General Public License) to calculate an area of a surface region (shell covering surface region) of a toner core covered with at least one of the first resin particles (non-chargeable resin particles) and the second resin particles (chargeable resin particles) included in the shell layer. The shell coverage was then calculated according to an equation "shell coverage (unit: %)=100×(area of shell covering surface region)/(area of entire surface region of toner core)". Note that the area of the entire surface region of the toner core in each field of view was 1 $\mu m^2$ (area of measurement range). Shell coverage was measured for five ranges in different fields of view per one toner particle. An arithmetic mean value of the shell coverages measured for the five ranges was defined as a shell coverage of one toner particle that is a measurement target. Shell coverages of ten toner particles included in the sample (toner) were measured. The number average value of the shell coverages of the ten toner particles was defined as an evaluation value (shell coverage) of the sample (toner).

<Method for Measuring Shell Chargeable Ratio>

(SPM Measurement Conditions)

Measurement probe: Cantilever ("SI-DF3-R" produced by Hitachi High-Tech Science Corporation, tip radius: 30 nm, probe coating material: rhodium (Rh), spring constant: 1.6 N/m, resonance frequency: 26 kHz).

Measurement mode: Kelvin probe force microscopy (KFM) mode.

Measurement range (per field of view): 1 μm×1 μm.

Resolution (X data/Y data): 256/256.

Q gain: five times.

Scanning frequency: 0.2 Hz.

A KFM image (image showing a distribution of surface potential) of a toner particle was captured while the surface potential of the toner particle was measured under feedback control through which difference in direct current potential between the toner particle and the probe at a tip end of the conductive cantilever was zero by applying alternating current voltage to the conductive cantilever in the above measurement mode (KFM mode, a measurement mode in which Kelvin method is applied to SPM). Image analysis was performed on the captured KFM image using image analysis software ("WinROOF" produced by Mitani Corporation) and GIMP to calculate an area of a surface region (shell covering surface region) of the toner core covered with at least one of the first resin particles (non-chargeable resin particles) and the second resin particles (chargeable resin particles) included in the shell layer and an area of a surface region (chargeable surface region) of the toner core covered with the second resin particles. The shell chargeable ratio was then calculated according to an equation "shell chargeable ratio=(area of chargeable surface region)/(area of shell covering surface region)". Shell chargeable ratios were measured for five ranges in different fields of view per one toner particle. An arithmetic mean value of the shell chargeable ratios for the measured five ranges was defined as a shell chargeable ratio of one toner particle that is a measurement target. Each shell chargeable ratio of ten toner particles included in the sample (toner) was measured. The number average value of the ten toner particles was defined as an evaluation value (shell chargeable ratio) of the sample (toner).

[Methods for Producing Toners TA-1 to TD]

(Preparation of Toner Cores)

An FM mixer ("FM-20B" produced by Nippon Coke & Engineering Co., Ltd.) was used to mix 750 g of a low-viscosity polyester resin (Tg: 38° C., Tm: 65° C.), 100 g of an intermediate-viscosity polyester resin (Tg: 53° C., Tm: 84° C.), 150 g of a high-viscosity polyester resin (Tg: 71° C., Tm: 120° C.), 55 g of a releasing agent ("Carnauba Wax No. 1" produced by S. Kato & Co.), and 40 g of a colorant ("KET Blue111" produced by DIC Corporation, component: Phthalocyanine Blue) at a rotational speed of 2,400 rpm. An increase in ratio of a low-viscosity polyester resin in a binder resin (polyester resin) can reduce melt viscosity of the binder resin.

Subsequently, a resultant mixture was melt-knead using a two screw extruder ("PCM-30" produced by Ikegai Corp.) under conditions of a material addition rate of 5 kg/hour, a shaft rotation speed of 160 rpm, and a temperature range (cylinder temperature) from at least 80° C. to no greater than 110° C. The resultant melt-knead product was then cooled.

Next, the melt-knead product was coarsely pulverized using a mechanical pulverizer ("Rotoplex (registered Japanese trademark)" produced by Hosokawa Micron Corporation). The resultant coarsely pulverized product was finely pulverized using a jet mill ("Model-I Super Sonic Jet Mill" produced by Nippon Pneumatic Mfg. Co., Ltd.). The resultant finely pulverized product was classified using a classifier ("ELBOW-JET Model EJ-LABO" produced by Nittetsu Mining Co., Ltd.) to obtain toner cores having a volume median diameter ($D_{50}$) of 7 μm.

(Preparation of First Shell Material)

A 1-L three-necked flask equipped with a thermometer and a stirring impeller was set in a water bath at a temperature of 30° C., and 875 mL of ion exchanged water and 75 mL of an anionic surfactant ("LATEMUL (registered Japanese trademark) WX" produced by Kao Corporation, component: polyoxyethylene alkyl ether sodium sulfate, solid concentration: 26% by mass) were added to the flask. Next, the internal temperature of the flask was increased to 80° C. using the water bath. Subsequently, two liquids (a first liquid and a second liquid) were each dripped into the flask contents at a temperature of 80° C. over five hours. The first liquid was a mixed liquid of 14 mL of styrene, 2 mL of butyl acrylate, and 4 mL of 2-hydroxyethyl methacrylate (HEMA). The second liquid was a solution in which 0.5 g of potassium peroxodisulfate was dissolved in 30 mL of ion exchanged water. Then, the flask contents were polymerized in a state in which the internal temperature of the flask was kept at 80° C. for two hours. As a result, a suspension (solid concentration: 10% by mass) of a non-chargeable resin (specifically, styrene-acrylic acid-based resin containing no charge control agent) was obtained. Resin particulates (first resin particles) included in the obtained suspension had a number average particle diameter of 38 nm. A test of introducing the resin particulates in the suspension into tetrahydrofuran (THF) was further carried out. The test result showed that the resin particulates swelled but are not dissolved.

(Preparation of Second Shell Material)

A 1-L three-necked flask equipped with a thermometer, a cooling pipe, a nitrogen inlet tube, and a stirring impeller was charged with 90 g of isobutanol, 100 g of methyl methacrylate, 35 g of butyl acrylate, 30 g of 2-(methacryloyloxy)ethyl trimethylammonium chloride (product of Alfa Aesar), and 6 g of 2,2'-azobis(2-methyl-N-(2-hydroxyethyl) propionamide) ("VA-086" produced by Wako Pure Chemical Industries, Ltd.). Subsequently, the flask contents were caused to react for three hours in a nitrogen atmosphere at a temperature of 80° C. Thereafter, 3 g of 2,2'-azobis(2-methyl-N-(2-hydroxyethyl)propionamide) ("VA-086" produced by Wako Pure Chemical Industries, Ltd.) was added to the flask contents to cause reaction of the flask contents for additional three hours in a nitrogen atmosphere at a temperature of 80° C., thereby obtaining a liquid including a polymer. The liquid including the polymer was subsequently dried in a reduced-pressure atmosphere at a temperature of 150° C. The dried polymer was then broken up to yield a positively chargeable resin.

Subsequently, 200 g of the positively chargeable resin yielded as above and 184 mL of ethyl acetate ("special grade" produced by Wako Pure Chemical Industries, Ltd.) were added to a vessel of a mixer ("HIVIS MIX (registered Japanese trademark) Model 2P-1" produced by PRIMIX Corporation). Then, the vessel contents were stirred for one hour at a rotational speed of 20 rpm using the mixer to yield a high-viscosity solution. Thereafter, 20 g of an aqueous solution of ethyl acetate and the like (specifically, an aqueous solution in which 18 mL of 1N-hydrochloric acid, 20 g of an anionic surfactant ("Emal (registered Japanese trademark) 0" produced by Kao Corporation, component: sodium lauryl sulfate), and 16 g of ethyl acetate ("special grade" produced by Wako Pure Chemical Industries, Ltd.) were dissolved in 562 g of ion exchanged water) was added to the yielded high-viscosity solution. As a result, a suspension (solid concentration: 10% by mass) of a chargeable resin (specifically, an acrylic acid-based resin having a repeating unit derived from 2-(methacryloyloxy)ethyl trimethylammonium chloride) was yielded. Resin particulates (second resin particles) included in the yielded suspension had a number average particle diameter of 35 nm.

(Formation of Shell Layer)

A three-necked flask equipped with a thermometer and a stirring impeller was prepared, and the flask was set in a water bath. The internal temperature of the flask was kept at 30° C. using the water bath. Subsequently, 2,500 mL of ion exchanged water and 250 g of sodium polyacrylate ("JURYMER (registered Japanese trademark) AC-103" produced by Toagosei Co., Ltd.) were added to the flask. As a result, an aqueous sodium polyacrylate solution was yielded in the flask.

Next, 1,000 g of the toner cores (powder) prepared as described above were added to the yielded aqueous sodium polyacrylate solution. Next, the flask contents were sufficiently stirred at room temperature. As a result, a dispersion of the toner cores was obtained in the flask.

Next, the resultant dispersion of the toner cores was filtered using filter paper having a pore size of 3 μm. Subsequently, the toner cores separated through the filtration were re-dispersed in ion exchanged water. Thereafter, the filtration and the re-dispersion were repeated five times in order to wash the toner cores. A suspension in which 500 g of the toner cores were dispersed in 2,500 mL of ion exchanged water was prepared in a flask.

Subsequently, 32.5 g of the first shell material (the suspension of the non-chargeable resin prepared as descried above) and 3.0 g of the second shell material (the suspension of the chargeable resin prepared as described above) were added to the flask. The pH of the suspension in the flask was then adjusted to pH 4 through addition of dilute hydrochloric acid to the flask.

The suspension of which pH had been adjusted was moved to a 1-L separable flask. Subsequently, the internal temperature of the flask was increased up to 65° C. at a heating rate of 0.5° C./min. using a water bath while the flask contents were stirred at a rotational speed of 100 rpm. The internal temperature of the flask was then kept at 65° C. for 50 minutes while the flask contents were stirred at a rotational speed of 150 rpm. Keeping the internal temperature of the flask at high temperature (65° C.) resulted in formation of shell layers on the surfaces of the toner cores. As a result, a dispersion including toner mother particles was obtained. The pH of the dispersion of the toner mother particles was adjusted to pH 7 (neutralization) using sodium hydroxide, and the dispersion of the toner mother particles was then cooled to normal temperature (approximately 25° C.).

(Washing)

Filtration (solid-liquid separation) was performed on the dispersion of the toner mother particles obtained as above to collect toner mother particles. The collected toner mother particles were re-dispersed in ion exchanged water. Dispersion and filtration were repeated in order to wash the toner mother particles.

(Drying)

Subsequently, the toner mother particles were dried using a vacuum mixer dryer ("Apex Mixer WB-5" produced by Pacific Machinery & Engineering Co., Ltd.) in a reduced-pressure atmosphere (pressure: 3.5 kPa) under conditions of specific temperature (temperature indicated in Table 1) and specific stirring speed (speed indicated in Table 1). For example, the temperature and the stirring speed in the drying process in producing the toner TA-1 were 40° C. and 30 rpm, respectively. The temperature was kept using a warm water jacket.

(External Addition)

External addition was performed on the toner mother particles after the drying as described above. Specifically, 100 parts by mass of the toner mother particles and 1.5 parts by mass of dry silica particles ("AEROSIL (registered Japanese trademark) REA90" produced by Nippon Aerosil Co., Ltd.) were mixed together using an FM mixer ("FM-20B" produced by Nippon Coke & Engineering Co., Ltd.) to attach an external additive (silica particles) to the surfaces of the toner mother particles. Next, sifting was performed on the obtained powder using a 200 mesh sieve (opening 75 μm) to produce a toner (each toner TA-1 to TD) including multiple toner particles.

[Methods for Producing Toners TE-1 and TE-2]

The toner TE-1 was produced according to the same method as for the toner TB-3 in all aspects other than that the first liquid and the second liquid were each dripped over seven hours instead of five hours in preparation of the first shell material. The toner TE-2 was produced according to the same method as for the toner TA-1 in all aspects other than that the first liquid and the second liquid were each dripped for seven hours instead of five hours in preparation of the first shell material.

[Methods for Producing Toners TF-1 and TF-2]

The toner TF-1 was produced according to the same method as for the toner TA-1 in all aspects other than that the amount of the anionic surfactant (Emal 0) was changed from 20 g to 10 g in preparation of the second shell material. The toner TF-2 was produced according to the same method as for the toner TA-3 in all aspects other than that the amount of the anionic surfactant (Emal 0) was changed from 20 g to 10 g in preparation of the second shell material.

Table 1 indicates measurement results of the number average particle diameter of the first resin particles, the number average particle diameter of the second resin particles, the shell roughness, the shell coverage, and the shell chargeable ratio in each toner TA-1 to TF-2 produced as above. For example, the toner TA-1 had a number average particle diameter of the first resin particles of 38 nm, a number average particle diameter of the second resin particles of 35 nm, a shell roughness of 13 nm, a shell coverage of 70%, and a shell chargeable ratio of 0.15. Note that the number average particle diameter of the first resin particles and that of the second resin particles were the same as respective particle diameters (diameters of particles in the suspension) at the addition.

[Evaluation Methods]

The samples (toners TA-1 to TF-2) were evaluated according to the following evaluation methods.

(Initial Evaluation)

An evaluation developer was obtained by mixing 100 parts by mass of a developer carrier (carrier for "FS-05300DN" produced by KYOCERA Document Solutions Inc.) and 10 parts by mass of the sample (toner) together for 30 minutes using a ball mill. Subsequently, the evaluation developer was left to stand for 24 hours in an environment at temperature of 20° C. and a humidity of 65% RH. Thereafter, the charge amount of the toner in the evaluation developer was measured under the following conditions using a Q/m meter ("MODEL 210HS-1" produced by TREK, INC.).

<Method for Measuring Charge Amount of Toner in Developer>

To a measurement cell of the Q/m meter, 0.10 g of the developer (the carrier and the toner) was added. Then, only toner in the added developer was sucked through a sieve (metal mesh) for ten seconds. The charge amount (unit: μC/g) of the toner in the developer was calculated according to an equation "total charge amount of sucked toner (unit: μC)/mass (unit: g) of sucked toner".

A toner having a charge amount of at least 25 μC/g and no greater than 35 μC/g was defined as good. A toner having a charge amount of less than 25 μC/g or greater than 35 μC/g was defined as poor.

Furthermore, an image was formed using the evaluation developer prepared as described above and the image density (ID) and the fogging density (FD) of the formed image were measured. A color printer ("FS-05300DN" produced by KYOCERA Document Solutions Inc.) was used as an evaluation apparatus. The evaluation developer prepared as described above was loaded into a developing device of the evaluation apparatus, and a sample (toner for replenishment use) was loaded into a toner container of the evaluation apparatus. A sample image including a solid section and a blank section was formed on a recording medium (evaluation paper) using the above evaluation apparatus. The image density (ID) of the solid section of the image formed on the recording medium was measured using a reflectance densitometer ("RD914" produced by X-Rite Inc.). Also, the blank section of the image formed on the recording medium was measured using a reflectance densitometer ("RD914" produced by X-Rite Inc.) to calculate the fogging density (FD). Note that the fogging density (FD) corresponds to a value obtained by subtracting the image density (ID) of base paper (paper yet to be subjected to printing) from the image density (ID) of a blank section of a recording medium subjected to printing.

An image having an image density (ID) of at least 1.20 was defined as good. An image having an image density (ID) of less than 1.20 was defined as poor. Furthermore, an image having a fogging density (FD) of less than 0.006 was defined as good and an image having a fogging density (FD) of no less than 0.006 was defined as poor.

(Evaluation after Printing Durability Test)

A printing durability test by continuous printing of 5,000 sheets at a printing rate of 5% was performed in an environment at a temperature of 20° C. and a humidity of 65% RH using the same evaluation apparatus as that used in the initial evaluation. The charge amount of the toner in the developer taken out from the developing device of the evaluation apparatus was measured after the printing durability test. Further, a sample image including a solid section and a blank section was formed on a recording medium (evaluation paper) using the evaluation apparatus and the image density (ID) and the fogging density (FD) of the formed image were measured. The respective measuring methods and the respective evaluation standards for the charge amount, image density (ID), and the fogging density (FD) were the same as those in the initial evaluation.

(Evaluation of Toner Detachment)

To a 20-mL plastic vessel, 100 g of a carrier (carrier for "FS-05300DN" produced by KYOCERA Document Solutions Inc.) and 6 g of a sample (toner) were added. The carrier and the toner were stirred for ten minutes using a powder mixer ("Rocking Mixer (registered Japanese trademark)" produced by AICHI ELECTRIC CO., LTD.) to obtain a developer. Subsequently, the resultant developer was caused to degrade using a forced degradation device (a device to cause degradation of a developer by applying physical stress) that was fabricated for dedicated purpose only. The forced degradation device included an aluminum container having a capacity of 100 mL and a stirring impeller driven by a motor to rotate in the container. When the developer is added to the container of the forced degradation device and the stirring impeller is rotated in the container, the developer was sandwiched between the inner wall of the container and the stirring impeller to degrade. Stirring (degradation treatment) by the forced degradation device for ten minutes yielded a developer subjected to degradation.

Subsequently, 3 g of the developer subjected to degradation was added to a 20-mL bottle and 0.18 g of a sample (toner not subjected to degradation) was further added. The bottle contents were then stirred for one minute using a powder mixer ("Rocking Mixer" produced by AICHI ELECTRIC CO., LTD.) to obtain an evaluation developer.

Subsequently, an electric field separation test was performed to obtain an amount of detached toner. First, the evaluation developer was filled in the evaluation apparatus (developing device). The developing device included a development roller having a length of 230 mm and a diameter of 20 mm. The development roller was a roller including a SUS304 cylinder (development sleeve) in which a magnet (magnet roll) was inserted. An electrode was set 4.5 mm apart from the development sleeve on which 2 g of the evaluation developer was applied uniformly. The development sleeve was rotated while 1.5 kV of voltage was applied to the electrode for 30 seconds. Then, the amount of detached toner (reversely charged toner) that was attached to the electrode was measured.

A toner in a state in which the mount of detached toner was less than 20 mg was defined as good. A toner in a state in which the amount of detached toner was no less than 20 mg was defined as poor.

[Evaluation Results]

Table 2 indicates evaluation results of the respective toners TA-1 to TF-2.

TABLE 2

| | | Initial | | | After printing durability test | | | |
|---|---|---|---|---|---|---|---|---|
| | Toner | ID | FD | Charge amount [μC/g] | ID | FD | Charge amount [μC/g] | Toner detachment [mg] |
| Example 1 | TA-1 | 1.30 | 0.002 | 30 | 1.25 | 0.002 | 28 | 15 |
| Example 2 | TA-2 | 1.27 | 0.001 | 32 | 1.24 | 0.002 | 31 | 13 |
| Example 3 | TA-3 | 1.32 | 0.003 | 28 | 1.29 | 0.003 | 25 | 18 |

TABLE 2-continued

| | | Initial | | | After printing durability test | | | |
|---|---|---|---|---|---|---|---|---|
| | Toner | ID | FD | Charge amount [μC/g] | ID | FD | Charge amount [μC/g] | Toner detachment [mg] |
| Example 4 | TB-1 | 1.31 | 0.002 | 32 | 1.23 | 0.002 | 29 | 14 |
| Example 5 | TB-2 | 1.31 | 0.002 | 30 | 1.24 | 0.001 | 28 | 15 |
| Example 6 | TE-1 | 1.30 | 0.002 | 29 | 1.23 | 0.001 | 27 | 14 |
| Example 7 | TF-1 | 1.31 | 0.003 | 28 | 1.26 | 0.002 | 27 | 17 |
| Comparative Example 1 | TB-3 | 1.19 (poor) | 0.002 | 36 (poor) | 1.17 (poor) | 0.003 | 32 | 12 |
| Comparative Example 2 | TB-4 | 1.30 | 0.006 (poor) | 24 (poor) | 1.23 | 0.008 (poor) | 20 (poor) | 22 (poor) |
| Comparative Example 3 | TC-1 | 1.28 | 0.003 | 32 | 1.35 | 0.006 (poor) | 24 (poor) | 22 (poor) |
| Comparative Example 4 | TC-2 | 1.29 | 0.003 | 31 | 1.36 | 0.007 (poor) | 24 (poor) | 21 (poor) |
| Comparative Example 5 | TD | 1.17 (poor) | 0.001 | 37 (poor) | 1.15 (poor) | 0.002 | 33 | 11 |
| Comparative Example 6 | TE-2 | 1.26 | 0.003 | 33 | 1.33 | 0.007 (poor) | 24 (poor) | 24 (poor) |
| Comparative Example 7 | TF-2 | 1.31 | 0.007 (poor) | 23 (poor) | 1.24 | 0.009 (poor) | 19 (poor) | 21 (poor) |

The toners TA-1 to TA-3, TB-1, TB-2, TE-1, and TF-1 (toners according to Examples 1-7) each had the basic structure described as above. Specifically, the toners according to Examples 1-7 each included shell layers each including the first resin particles containing no charge control agent and the second resin particles containing a charge control agent. As indicated in Table 1, the number average particle diameter of the first resin particles was at least 30 nm and no greater than 60 nm, and the number average particle diameter of the second resin particles was at least 30 nm and no greater than 60 nm in the toners according to Examples 1-7. Each shell coverage was at least 60% and no greater than 80% in the toners according to Examples 1-7. Each shell chargeable ratio was at least 0.10 and no greater than 0.20 in the toners according to Examples 1-7. Each shell roughness was at least 10 nm and no greater than 15 nm in the toners according to Examples 1-7.

As indicated in Table 2, favorable results were obtained in evaluation of the charge amount, the image density (ID), and the fogging density (FD) in the toners according to Examples 1-7 both at the initial stage and after the printing durability test. Furthermore, evaluation results of toner detachment for the toners according to Examples 1-7 were good. Even in the continuous printing, high-quality images could be formed using any of the toners according to Examples 1-7 while continual fogging was inhibited from occurring over a long period of time.

What is claimed is:

1. An electrostatic latent image developing toner comprising a plurality of toner particles each including a core and a shell layer disposed over a surface of the core, wherein the shell layer includes first resin particles containing no charge control agent and second resin particles containing a charge control agent, a number average particle diameter of the first resin particles is at least 30 nm and no greater than 60 nm and a number average particle diameter of the second resin particles is at least 30 nm and no greater than 60 nm, a rate of an area of a surface region of the core covered with at least one of the first resin particles and the second resin particles relative to an area of an entire surface region of the core is at least 60% and no greater than 80%, a ratio of an area of a surface region of the core covered with the second resin particles relative to the area of the surface region of the core covered with at least one of the first resin particles and the second resin particles is at least 0.10 and no greater than 0.20, and a roughness of surface regions of the toner particles in which no external additive is present is at least 10 nm and no greater than 15 nm.

2. The electrostatic latent image developing toner according to claim 1, wherein the first resin particles and the second resin particles are each formed substantially from a resin having a repeating unit derived from a vinyl compound.

3. The electrostatic latent image developing toner according to claim 2, wherein a rate of a repeating unit having a hydrophilic functional group is no greater than 10% by mass relative to all repeating units included in each of the resin forming the first resin particles and having the repeating unit derived from the vinyl compound and the resin forming the second resin particles and having the repeating unit derived from the vinyl compound, and the hydrophilic functional group is an acid group, a hydroxyl group, or a salt thereof.

4. The electrostatic latent image developing toner according to claim 2, wherein the second resin particles are each formed substantially from a resin having a repeating unit derived from the charge control agent.

5. The electrostatic latent image developing toner according to claim 4, wherein the repeating unit derived from the charge control agent is a repeating unit derived from a (meth)acryloyl group-containing quaternary ammonium compound.

6. The electrostatic latent image developing toner according to claim 1, wherein the first resin particles and the second resin particles are each formed substantially from an acrylic acid-based resin or a styrene-acrylic acid-based resin.

7. The electrostatic latent image developing toner according to claim 1, wherein the first resin particles are formed substantially from a styrene-acrylic acid-based resin, and the second resin particles are formed substantially from an acrylic acid-based resin having a repeating unit derived from a (meth)acryloyl group-containing quaternary ammonium compound.

8. The electrostatic latent image developing toner according to claim 7, wherein the repeating unit derived from the (meth)acryloyl group-containing quaternary ammonium compound is a repeating unit represented by chemical formula (1) shown below:

(1)

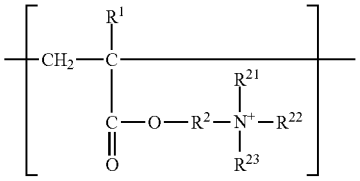

where in formula (1), $R^1$ represents a hydrogen atom or a methyl group, $R^{21}$, $R^{22}$, and $R^{23}$ represent, independently of one another, a hydrogen atom, an optionally substituted alkyl group, or an optionally substituted alkoxy group, and $R^2$ represents an optionally substituted alkylene group.

9. The electrostatic latent image developing toner according to claim 1, wherein the toner particles each further include inorganic particles as an external additive.

* * * * *